US007152731B2

(12) United States Patent
Draghetti et al.

(10) Patent No.: US 7,152,731 B2
(45) Date of Patent: Dec. 26, 2006

(54) PACK OF RIGID TYPE FOR TOBACCO PRODUCTS

(75) Inventors: Fiorenzo Draghetti, Medicina (IT); Eros Stivani, Bologna (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 10/381,747

(22) PCT Filed: Oct. 1, 2001

(86) PCT No.: PCT/IB01/01820

§ 371 (c)(1),
(2), (4) Date: Mar. 28, 2003

(87) PCT Pub. No.: WO02/28744

PCT Pub. Date: Apr. 11, 2002

(65) Prior Publication Data

US 2004/0035721 A1 Feb. 26, 2004

(30) Foreign Application Priority Data

Oct. 3, 2000 (IT) ..... B02000A0575

(51) Int. Cl.
*B65D 85/10* (2006.01)

(52) U.S. Cl. ..... 206/259; 206/268; 206/273; 206/831

(58) Field of Classification Search ..... 206/242, 206/265, 268, 271, 273, 831, 259; 229/160.1, 229/162
See application file for complete search history.

(56) References Cited

U.S. PATENT DOCUMENTS

| | | | | |
|---|---|---|---|---|
| 4,948,038 | A * | 8/1990 | Moeller | 206/273 |
| 5,137,148 | A | 8/1992 | Evers | |
| 5,533,613 | A * | 7/1996 | Minarelli et al. | 206/268 |
| 5,715,936 | A * | 2/1998 | Focke et al. | 206/268 |
| 5,826,785 | A | 10/1998 | Belvederi et al. | |
| 6,138,823 | A | 10/2000 | Focke et al. | |
| 6,164,444 | A * | 12/2000 | Bray et al. | 206/268 |
| 6,199,688 | B1 * | 3/2001 | Focke | 206/268 |
| 2004/0026271 | A1 * | 2/2004 | Conti et al. | 206/259 |

FOREIGN PATENT DOCUMENTS

| | | |
|---|---|---|
| DE | 8618368 | 10/1986 |
| DE | 9315457 | 3/1994 |
| DE | 19821254 | 11/1999 |
| EP | 0609753 | 8/1994 |
| EP | 0671342 | 9/1995 |
| EP | 0837012 | 4/1998 |

* cited by examiner

*Primary Examiner*—Luan K. Bui
(74) *Attorney, Agent, or Firm*—Timothy J. Klima

(57) ABSTRACT

A pack of rigid type for tobacco products, substantially of prismatic geometry and presenting a plurality of side faces (15, 16, 17; 34, 35, 36, 37), comprises a container (3; 29; 40), a lid (5; 30; 41), and a coupon (24) inserted inside the pack (1), disposed in contact with at least one of the side faces (15, 16, 17; 34, 35, 36, 37). At least one of the side faces (15, 16, 17; 34, 35, 36, 37) of the pack (1) presents a window (25) serving to expose a predetermined area (27) of the inserted coupon (24) bearing advertisements, messages and written matter addressed to the consumer. Where the pack (1) has a reinforcing frame (20) positioned internally of the container (3; 29), the window (25) is afforded by a face (7) of the container occupied by the frame (20) and the frame itself affords a respective window (26) substantially coinciding with the window (25) in the container.

8 Claims, 6 Drawing Sheets

PACK OF RIGID TYPE FOR TOBACCO PRODUCTS

This application is the National Phase of International Application PCT/IBO1/01820 filed Oct. 1, 2001 which designated the U.S. and that International Application was published under PCT Article 21(2) in English.

TECHNICAL FIELD

The present invention relates to a pack of rigid type for tobacco products.

BACKGROUND ART

In the following specification, the term "pack" can be taken to mean both a carton containing a plurality of packets of cigarettes, and a single packet containing a group of cigarettes or tobacco products in general.

Rigid packs of the type in question are fashioned generally from respective flat precreased diecut blanks, the single pack comprising a container and a lid which, in the case of the packet in particular, is attached hingedly to a rear edge of the container in such a way as to enclose an open end of the selfsame container, also a reinforcing frame disposed partly inside the container and secured thus internally to a front face and to two flank faces of the selfsame container.

It is increasingly the practice to print advertisements, messages and other written matter on the outer surface of these packs, addressed to the consumer, which must be placed clearly in view, expressed in the language of the various countries where the product is sold and, moreover, customized on a case by case basis to ensure conformity with national statutory requirements in different countries.

In certain countries it is also normal for the price of the product to be printed on the outer surface of the pack and, especially in those countries where changes in price are frequent due to significant inflationary factors, the written matter printed on the pack must often be changed and adapted in response to market conditions.

All this dictates that the diecut blanks used to fashion the packs must be differentiated from country to country, and even for each individual country, with resulting high inventory and production costs.

It is also the practice to manufacture packs of the type in question furnished internally with inserts, namely cards, coupons and the like, bearing written and pictorial images addressed to the consumer.

The object of the present invention is to avoid the use of different blanks, adopting a single standard blank for all countries and utilizing the inserts as the background on which to print the advertisements, messages and other written matter addressed to the consumer.

DISCLOSURE OF THE INVENTION

The stated object is realized according to the present invention in a pack of rigid type for tobacco products, substantially of prismatic geometry, presenting a plurality of side faces and comprising a container, a lid, and a coupon inserted inside the pack, disposed in contact with at least one of the side faces, characterized in that at least one of the side faces presents a window serving to expose a predetermined area of the inserted coupon bearing advertisements, messages and written matter addressed to the consumer.

The invention will now be described in detail, by way of example, with the aid of the accompanying drawings, in which.

Figure 1:
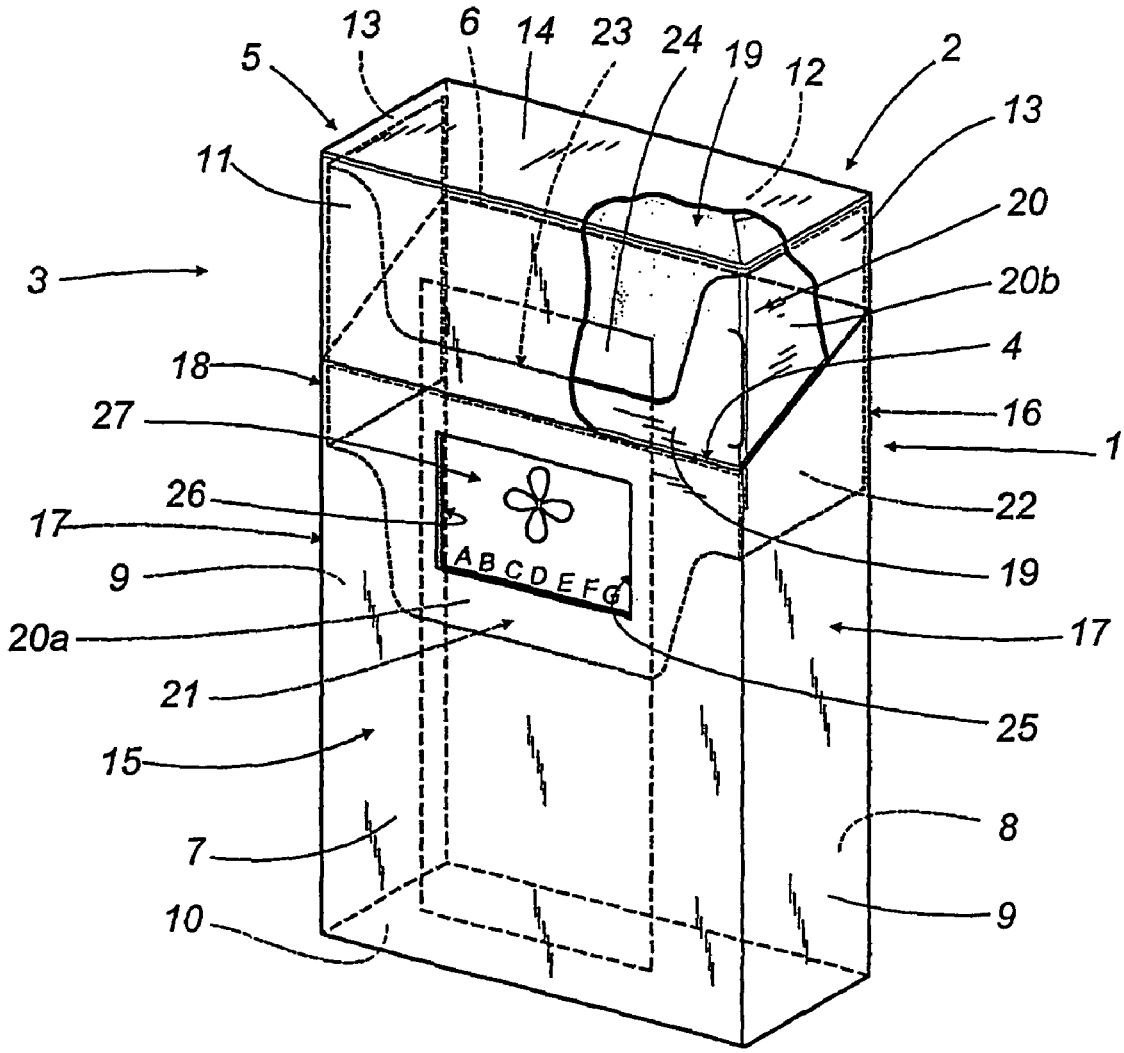
FIGS. 1, 2 and 3 illustrate three packets of cigarettes embodied in accordance with the present invention, viewed schematically and in perspective.
Figure 2:
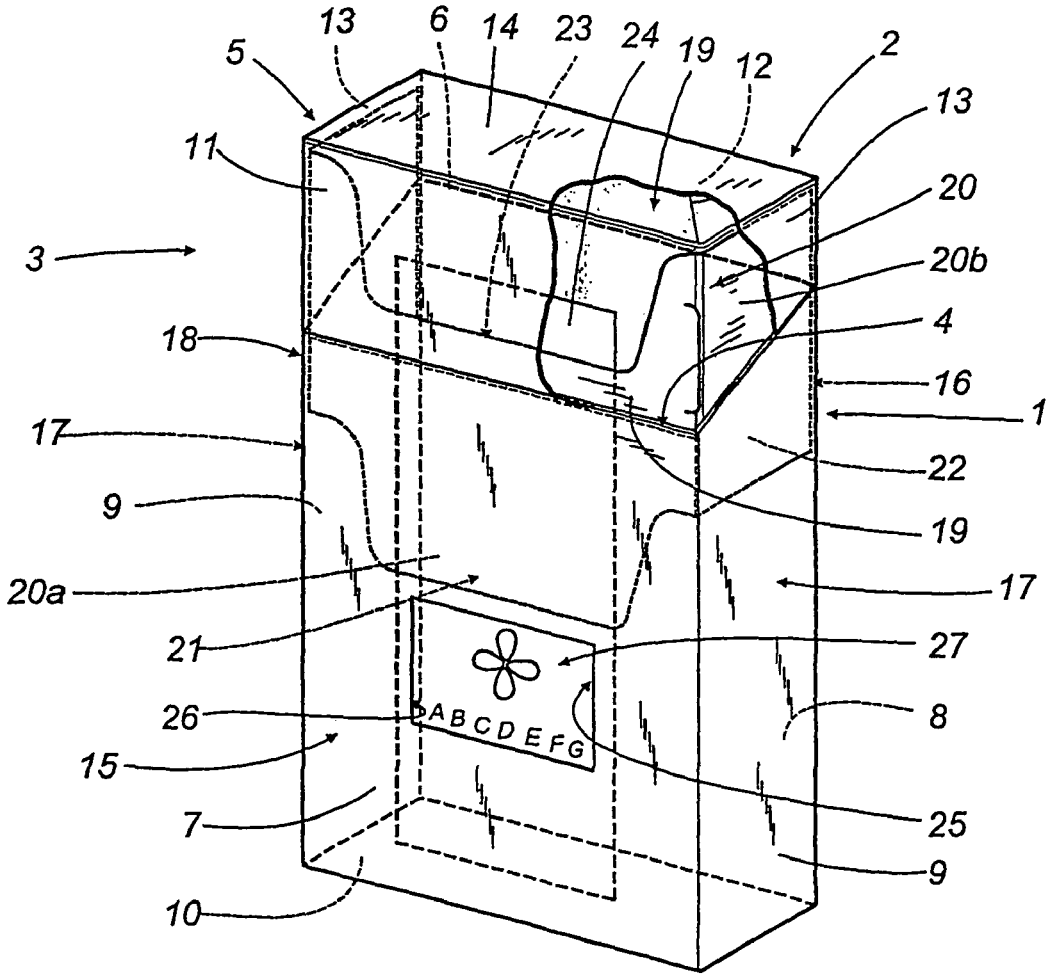
Figure 3:
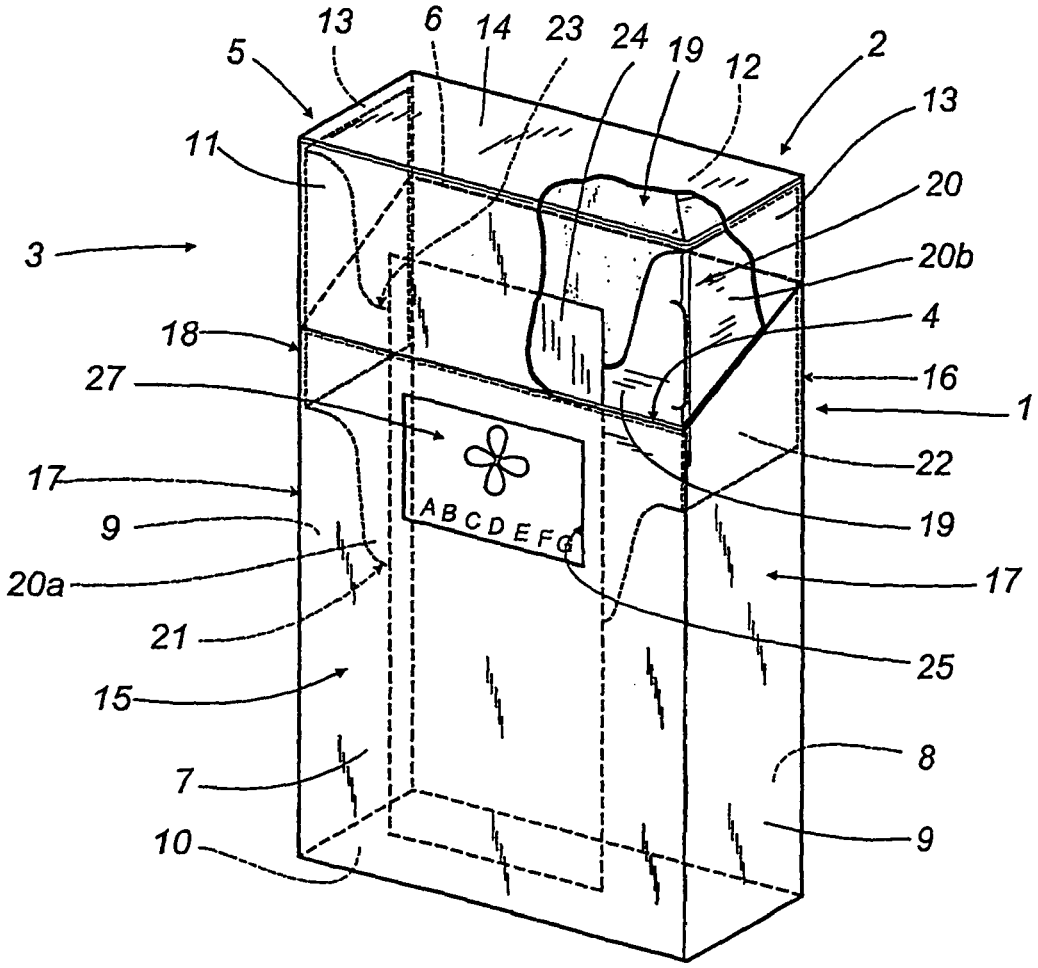

With reference to FIGS. 1, 2 and 3 of the drawings, 1 denotes a pack for tobacco products, in its entirety, which in this particular instance consists in a rigid packet 2 such as will contain a group of cigarettes (not illustrated), comprising a container 3 of cupped embodiment affording an open top end 4, surmounted by a lid 5 likewise of cupped embodiment hinged to the container 3 along a relative hinge line 6 and rotatable thus between a open position (not illustrated), and a position in which the top end 4 is closed.

The container 3 presents a front face 7, a rear face 8, two flank faces 9 and a bottom end face 10; in like manner the lid 5 presents a front face 11, a rear face 12, two flank faces 13 and a top end face 14.

The aforementioned front, rear and flank faces of the container 3 and the lid 5 together constitute respective side faces of the assembled pack 1, of which the front face is denoted 15, the rear face denoted 16 and the flank faces denoted 17, these in turn combining with the bottom end face 10 of the container 3 and the top end face 14 of the lid 5 to define an outer wrapper 18 of the packet 2.

Each packet 2 accommodates an inner wrapper 19 enveloping the aforementioned group of cigarettes, and is furnished with a reinforcing frame 20 interposed between the outer wrapper 18 and the inner wrapper 19 and secured thus to the container 3. The frame 20 comprises a portion 20*a* located internally of the container 3 and a portion 20*b* projecting externally of the container from the open top end 4.

More particularly, the frame 20 includes a breast piece 21 located partly in contact with the inside of the front face 7 of the container 3, and two side pieces 22 secured in part to the insides of the flank faces 9 of the container 3.

The breast piece 21 of the frame 20 is delimited uppermost by an edge 23 of "U" outline disposed with the concave profile directed toward the lid 5.

Lastly, each packet 2 is furnished with a coupon 24 interposed between the frame 20 and the inner wrapper 19. In the examples of FIGS. 1 and 2 the coupon 24 is positioned below the breast piece 21 of the frame and partly in contact with the inside of the front face 7 of the container 3, its top end extending beyond the top edge 23 of the frame 20.

Alternatively, as in the example of FIG. 3, the coupon 24 can be interposed between the frame 20 and the inside of the front face 7 of the container 3.

In the example of FIG. 1, the packet 2 presents a window 25 afforded by the front face 7 of the container 3, positioned to coincide with the breast piece 21 of the frame 20 which likewise affords a window 26 coinciding substantially with the window 25 in the front face 7. In this way, it becomes possible to expose an area 27 of the coupon 24 bearing written and pictorial matter addressed to the consumer, thereby obviating the need to print such matter directly on the outer wrapper 18 of the packet 2.

In the example of FIG. 2, the window 25 is positioned in an area of the front face 7 of the container 3 not occupied by the frame 20, which therefore does not present a relative window 26. Likewise in this instance the window 25 serves to expose an area 27 of the coupon 24 bearing written and pictorial, matter addressed to the consumer.

In the example of FIG. 3, the window 25 is positioned in an area of the front face 7 of the container 3 coinciding with the breast piece 21 of the frame 20, although the frame does not present a relative window 26 since the coupon 24 is positioned in front of the breast piece 21.

In a further embodiment not illustrated in the drawings, the window 25 might be positioned in an area of the front face 7 of the container 3 occupied only in part by the frame 20. Rather than the full window 26, in this instance, the frame 20 might present a cutaway portion of dimensions sufficient to expose the aforementioned area 27 of the coupon 24.

Figure 4:
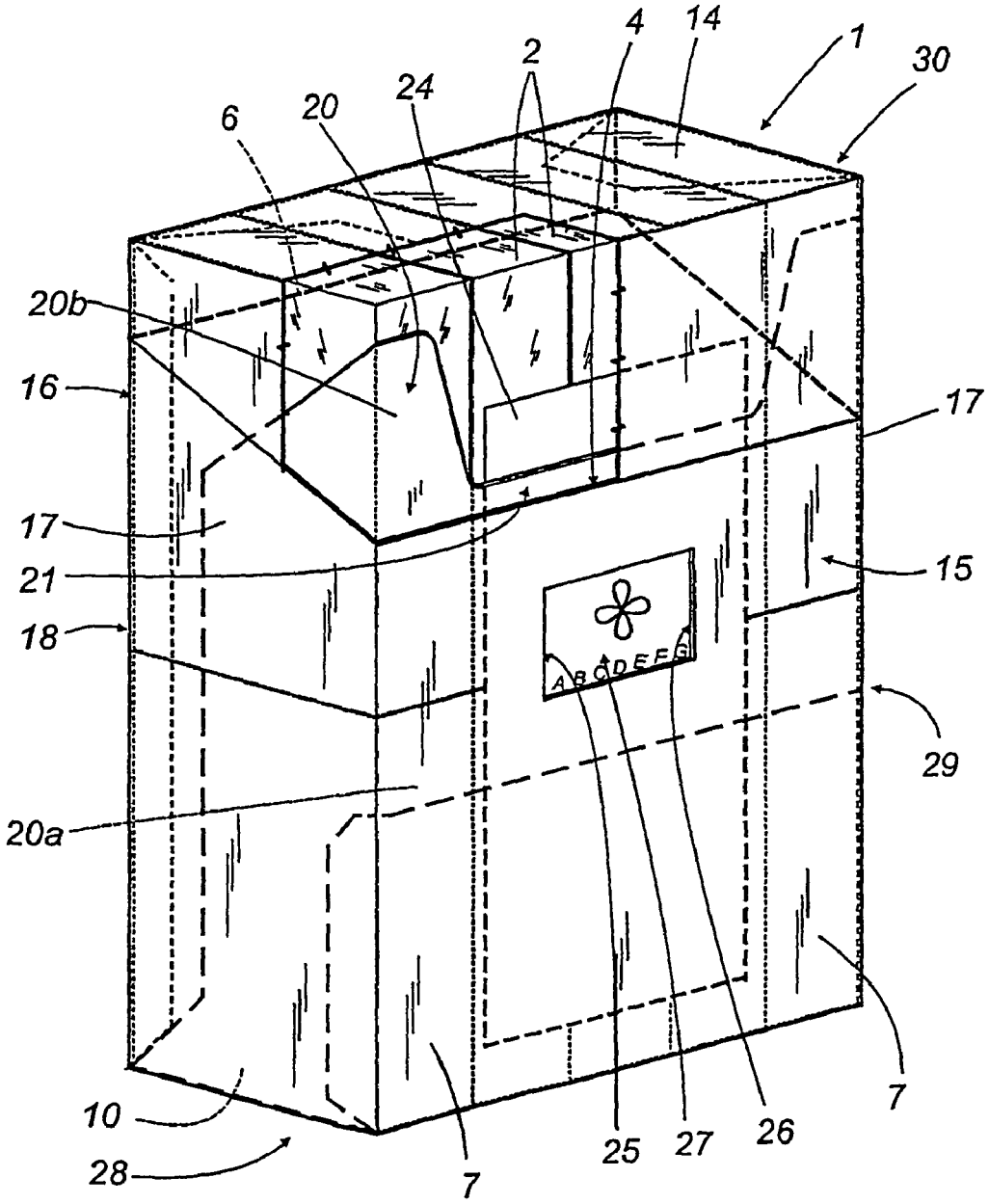
FIGS. 4 and 5 illustrate two cartons for packets of cigarettes exemplifying a first embodiment of a relative pack according to the present invention, viewed schematically and in perspective.
Figure 5:
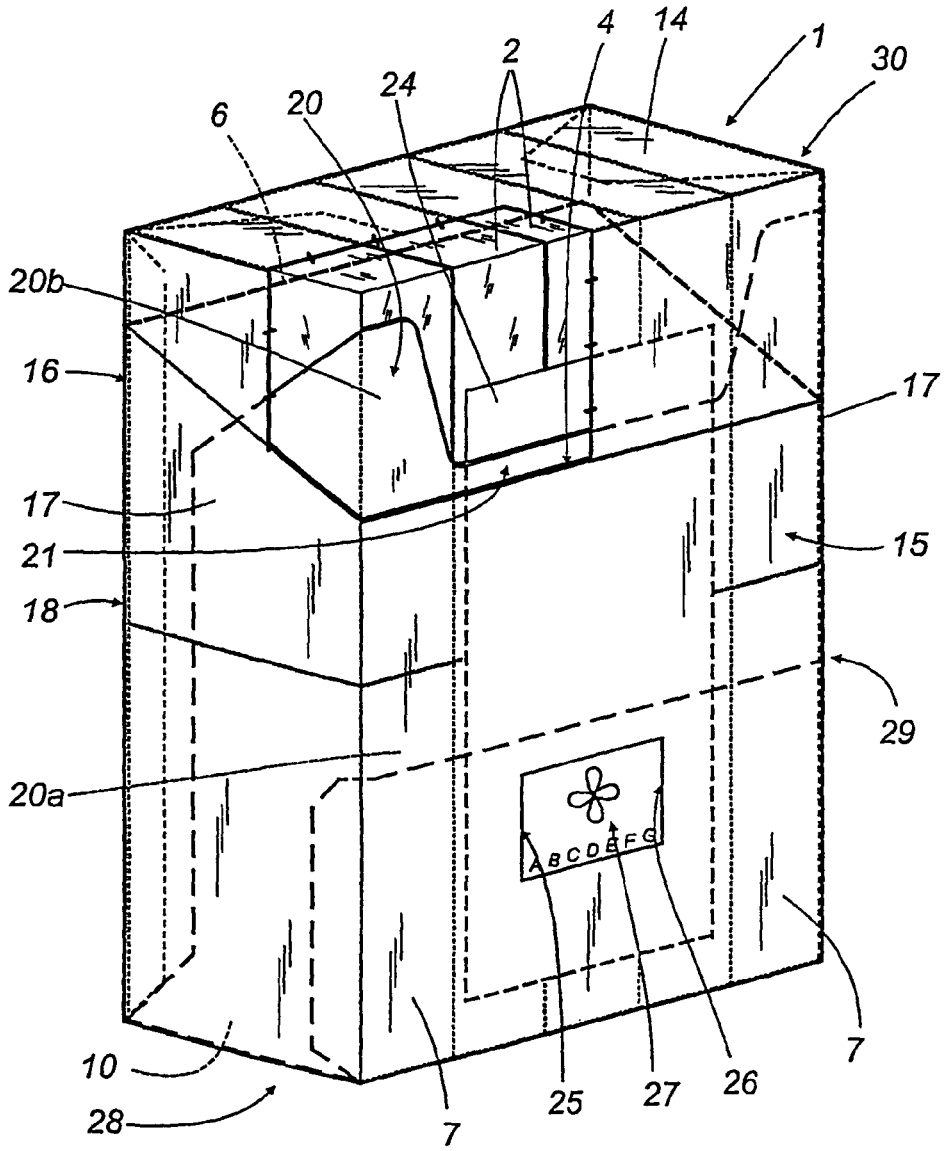

In the examples of FIGS. 4 and 5, the packs 1 consist in rigid cartons 28 serving to contain a plurality of packets 2 of cigarettes. The geometry of the cartons 28 is similar in all respects to that of the packets 2 illustrated in FIGS. 1, 2 and 3, and accordingly, the component parts are denoted where possible by the same reference numbers as used to denote the corresponding parts of the packets 2.

The single carton 28 comprises a container 29 surmounted by a lid 30, hinged to the container along a relative hinge line 6 and rotatable thus between an open position (not illustrated) and a position in which the open top end 4 of the container 29 is closed, also a reinforcing frame 20 secured to the container 29, comprising a portion 20*a* located internally of the container 29 and a portion 20*b* projecting externally of the container 29 from the open top end 4.

Recalling the description already given with reference to the packets 2 illustrated in FIGS. 1, 2 and 3, the front, rear and flank faces of the container 29 and the lid 30 combine likewise in the case of the carton 28 to constitute respective side faces of the assembled pack 1, of which the front face is denoted 15, the rear face denoted 16 and the flank faces denoted 17, these in turn combining with the bottom end face 10 of the container 29 and the top end face 14 of the lid 30 to define an outer wrapper 18 of the carton 28.

Accordingly, in similar fashion to the packets 2, the carton 28 illustrated in FIG. 4 presents a window 25 afforded by the front face 7 of the container 29, positioned to coincide with the breast piece 21 of the frame 20 which likewise affords a window 26 coinciding substantially with the window 25 in the front face 7 in such a manner as to expose a predetermined area 27 of the coupon 24.

In the example of FIG. 5 the window 25 is positioned in an area of the front face 7 of the container 29 not occupied by the frame 20, which therefore does not present a relative window 26. Likewise in this instance the window 25 serves to expose an area 27 of the coupon 24 bearing written and pictorial matter addressed to the consumer.

In a further embodiment not illustrated in the drawings, the carton 28 could be assembled with the coupon 24 disposed as in the packet 2 illustrated in FIG. 3.

Figure 6:
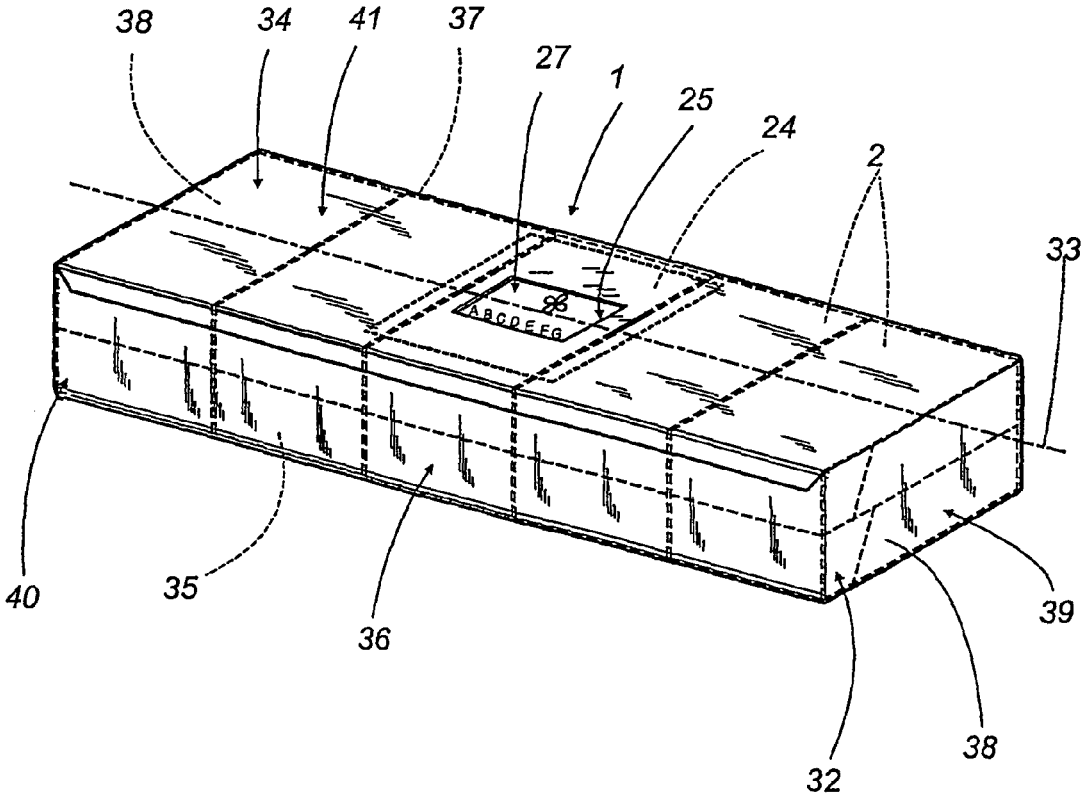
FIG. 6 illustrates a carton for packets of cigarettes exemplifying a second embodiment of a relative pack according to the present invention, viewed schematically and in perspective.

In the example of FIG. 6, the pack 1 consists in a carton 31 presenting an outer wrapper 32 substantially of flattened parallelepiped geometry referable to a predominating longitudinal axis denoted 33.

The carton 31 presents two mutually parallel larger side faces 34 and 35, two mutually parallel smaller side faces 36 and 37 disposed perpendicular to the larger side faces 34 and 35, and two transverse end faces 38 and 39.

As discernible from FIG. 6, the smaller side faces 36 and 37, the end faces 38 and 39 and the larger side-face denoted 35 combine to establish a container 40, whilst the remaining side face 34 functions as a lid 41.

In accordance with the present invention, the carton 31 is furnished with a coupon 24 interposed between the upwardly directed larger side face 34, which serves as the lid 41, and the packets 2 accommodated internally of the of the carton 31, and affords a window 25 located in the selfsame larger side face 34 in such a manner as to expose an area 27 of the coupon 24 bearing written and pictorial matter addressed to the consumer.

In a further embodiment not illustrated in the drawings, the window 25 could be located in the front smaller side face 36. In this instance the coupon 24 would therefore be positioned in such a way that at least one portion coincides with the front face 36.

The invention claimed is:

1. A pack of rigid type for tobacco products, substantially of prismatic geometry, presenting a plurality of side faces and comprising a container and a lid, said pack including a reinforcing frame interposed between an outer wrapper of the pack and the products, wherein the pack comprises a coupon inserted inside the pack and disposed in contact with at least one of the side faces; at least one of the side faces presenting a window serving to expose a predetermined area of the inserted coupon bearing at least one from the group of advertisements, messages and written matter addressed to the consumer; said coupon being interposed between the reinforcing frame and the products.

2. A pack as in claim 1, containing a plurality of packets of cigarettes, wherein the outer wrapper is substantially flat and parallelepiped, presenting two mutually parallel larger side faces, two mutually parallel smaller side faces disposed perpendicular to the larger faces, and two transverse end faces, the window being formed in at least one of the side faces.

3. A pack as in claim 1, wherein the outer wrapper comprises said container, the container having a cupped configuration and being surmounted by said lid, the lid being likewise of cupped configuration, hinged to the container and rotatable thus between an open position and a closed position, said outer wrapper also comprising a reinforcing frame disposed internally of and secured in part to the container.

4. A pack as in claim 3, wherein said window is formed in a face of the container occupied by the frame; said frame presenting a respective window coinciding substantially with the window formed in the face of the container.

5. A pack as in claim 3, wherein said window is formed in a face of the container not occupied by the reinforcing frame.

6. A pack as in claim 3, wherein said window is formed in a face of the container partially occupied by the reinforcing frame.

7. A pack as in claim 3, containing a group of cigarettes.

8. A pack as in claim 3, containing a plurality of packets of cigarettes.

* * * * *